US012637731B2

(12) United States Patent
Ahn et al.

(10) Patent No.: US 12,637,731 B2
(45) Date of Patent: May 26, 2026

(54) STEEL SHEET HAVING EXCELLENT FORMABILITY AND STRAIN HARDENING RATE

(71) Applicant: POSCO CO., LTD, Pohang-si (KR)

(72) Inventors: Yeon-Sang Ahn, Gwangyang-si (KR); Joo-Hyun Ryu, Gwangyang-si (KR); Kang-Hyun Choi, Gwangyang-si (KR); Eul-Yong Choi, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 535 days.

(21) Appl. No.: 18/017,066

(22) PCT Filed: Jun. 29, 2021

(86) PCT No.: PCT/KR2021/008172

§ 371 (c)(1),
(2) Date: Jan. 19, 2023

(87) PCT Pub. No.: WO2022/019509

PCT Pub. Date: Jan. 27, 2022

(65) Prior Publication Data

US 2023/0295759 A1 Sep. 21, 2023

(30) Foreign Application Priority Data

Jul. 22, 2020 (KR) ..... 10-2020-0090718

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46
See application file for complete search history.

(56) References Cited

U.S. PATENT DOCUMENTS 11,519,051 B2 * 12/2022 Ahn ..... C23C 2/024
11,827,950 B2 * 11/2023 Ahn ..... C23C 2/02
(Continued)

FOREIGN PATENT DOCUMENTS

CN 107164695 A 9/2017
CN 108431273 A 8/2018
(Continued)

OTHER PUBLICATIONS

International Search Report—PCT/KR2021/008172 dated Sep. 24, 2021.
(Continued)

*Primary Examiner* — Christopher S Kessler
(74) *Attorney, Agent, or Firm* — CANTOR COLBURN LLP

(57) ABSTRACT

Provided is a steel sheet suitably used for an automobile structural member and the like, and more particularly, to a steel sheet having high strength and excellent formability that may prevent processing defects such as cracks or wrinkles occurring during the press-forming, and a method for producing the same.

5 Claims, 1 Drawing Sheet

(51) Int. Cl.

| | |
|---|---|
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/60*** | (2006.01) |

(52) U.S. Cl.

CPC ..... *C21D 8/02* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/26* (2013.01); *C22C 38/28* (2013.01); *C22C 38/32* (2013.01); *C22C 38/38* (2013.01); *C22C 38/60* (2013.01); *C21D 2211/001* (2013.01); *C21D 2211/005* (2013.01); *C21D 2211/008* (2013.01)

(56) References Cited

U.S. PATENT DOCUMENTS

| | | | | |
|---|---|---|---|---|
| 2008/0000555 | A1 | 1/2008 | Nonaka et al. | |
| 2013/0295410 | A1 | 11/2013 | Takahashi et al. | |
| 2016/0319388 | A1* | 11/2016 | Kim | C22C 38/06 |
| 2017/0260602 | A1 | 9/2017 | An et al. | |
| 2018/0371570 | A1 | 12/2018 | Kim et al. | |
| 2019/0203316 | A1 | 7/2019 | Minami et al. | |
| 2020/0190640 | A1 | 6/2020 | Seo et al. | |
| 2020/0347476 | A1* | 11/2020 | Ahn | C22C 38/60 |
| 2021/0071277 | A1 | 3/2021 | Han et al. | |
| 2022/0298596 | A1* | 9/2022 | Ahn | C21D 8/0247 |

FOREIGN PATENT DOCUMENTS

| | | | |
|---|---|---|---|
| EP | 3730635 | | 10/2020 |
| JP | 2003171736 | A | 6/2003 |
| JP | 2005264176 | | 9/2005 |
| JP | 2006104532 | A | 4/2006 |
| JP | 2007224416 | A | 9/2007 |
| JP | 2008056993 | A | 3/2008 |
| JP | 2008280577 | A | 11/2008 |
| JP | 2010090432 | | 4/2010 |
| JP | 2013064172 | A | 4/2013 |
| JP | 2016180138 | | 10/2016 |
| JP | 2018035399 | | 3/2018 |
| KR | 20130034202 | | 4/2013 |
| KR | 101518606 | B1 | 5/2015 |
| KR | 20150073844 | | 7/2015 |
| KR | 20190076258 | | 7/2019 |
| KR | 20190076307 | | 7/2019 |
| KR | 20190077191 | | 7/2019 |
| WO | 2013105638 | A1 | 7/2013 |
| WO | 2014024831 | A1 | 2/2014 |
| WO | 2018168969 | A1 | 9/2018 |
| WO | 2019122965 | A1 | 6/2019 |
| WO | 2019124693 | A1 | 6/2019 |
| WO | 2019221284 | A1 | 11/2019 |
| WO | 2020058748 | A1 | 3/2020 |

OTHER PUBLICATIONS

European Search Report—European Application No. 21845902.2 issued on Apr. 22, 2025, citing WO 2019/124693 A1, US 2020-0190640 A1, KR 10-1518606 B1, JP 2013-064172 A and US 2013-0295410 A1.

Chinese Office Action—Chinese Application No. 202180060571.2 issued on Jul. 31, 2024, citing US 2019/0203316, CN107164695A, and CN108431273A.

Japanese Office Action—Japanese Application No. 2023-504084 issued on Feb. 13, 2024, citing WO 2013/105638, JP 2008-56993, JP 2008-280577, WO 2019/122965, WO 2020/058748, JP 2006-104532, JP 2007-224416, JP 2003-171736, WO 2014/024831, WO 2019/221284, and WO 2018/168969.

* cited by examiner

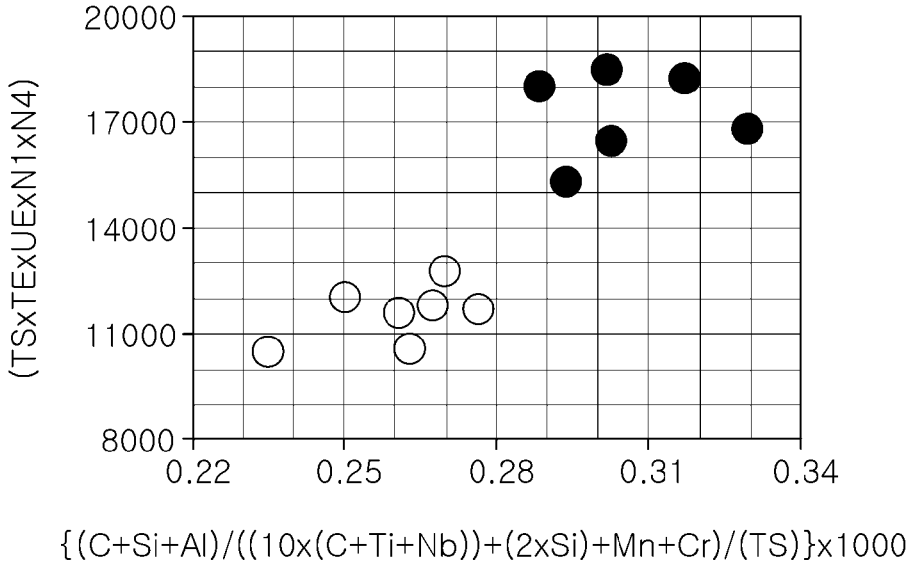
20000
17000
14000
11000
8000
(TSxTExUExN1xN4)
0.22
0.25
0.28
0.31
0.34
{(C+Si+Al)/((10x(C+Ti+Nb))+(2xSi)+Mn+Cr)/(TS)}x1000

STEEL SHEET HAVING EXCELLENT FORMABILITY AND STRAIN HARDENING RATE

TECHNICAL FIELD

The present disclosure relates to a steel sheet suitably used for an automobile structural member and the like, and more particularly, to a steel sheet having high strength with an excellent strain hardening rate and formability, and a method for producing the same.

BACKGROUND ART

Recently, in automobile industries, environmental and safety regulations are becoming stricter and carbon dioxide ($CO_2$) emission regulations are also becoming stricter. Therefore, fuel consumption regulations are being tightened.

The Insurance Institute for Highway Safety (IIHS) in the USA has gradually strengthened crash safety regulations for protecting passengers, and has required strict crash performance such as 25% small-overlap since 2013.

The only solution that may solve these environmental and safety issues is to achieve lightening of an automobile. In order to achieve the lightening of the automobile, high strength of a steel material is required, and high formability is also required to apply the high-strength steel material.

In general, as a method for strengthening steel, solid solution strengthening, precipitation strengthening, strengthening by grain refinement, transformation strengthening, or the like may be used.

Thereamong, the solid solution strengthening and the strengthening by grain refinement are limited in producing high-strength steel having a tensile strength of 490 MPa or more.

Meanwhile, precipitation-strengthened high-strength steel is a technique to strengthen a steel sheet by precipitating carbonitride through the addition of carbonitride forming elements such as Cu, Nb, Ti, and V or to secure strength by refinement of grains through suppression of grain growth by fine precipitates. This precipitation strengthening technique has the advantage that high strength may be easily obtained as compared to low production costs, but has the disadvantage that high-temperature annealing is required in order to secure ductility by formation of sufficient recrystallization because the recrystallization temperature is rapidly increased due to the fine precipitates.

In addition, the precipitation-strengthened steel that is strengthened by precipitating carbonitrides in a ferrite matrix is limited in obtaining high-strength steel of 600 MPa or more.

As transformation-strengthened high-strength steel, various types of steel such as ferrite-martensite dual-phase (DP) steel in which a hard martensite phase is formed in a ferrite matrix, transformation induced plasticity (TRIP) steel using transformation induced plasticity of retained-austenite, and complex phase (CP) steel composed of ferrite and a hard bainite or martensite structure have been developed.

Recently, as a steel sheet for an automobile, a steel sheet having higher strength has been required to improve fuel efficiency, durability, and the like, the use of a high-strength steel sheet having a tensile strength of 490 MPa or more has increased as a steel sheet for an automobile structure or a reinforcing material for safety against collision and passenger protection.

However, as the strength of the material is gradually increased, defects such as cracks or wrinkles occur in a process of press-forming an automobile part, resulting in limitation in manufacturing of complex parts.

Therefore, in terms of improving workability of the high-strength steel, when a uniform elongation (UE) and a strain hardening rate in a strain section of 10% or more of the DP steel, which is recently most widely used among the transformation-strengthened high-strength steels, may be increased, it is estimated that processing defects such as the cracks or wrinkles occurring during the press-forming are prevented, and thus, the application of the high-strength steel to complex parts may be expanded.

Meanwhile, as a conventional technique for improving workability of a high-tensile strength steel sheet, Patent Document 1 discloses a steel sheet formed of a composite structure mainly composed of a martensite phase, and discloses a method for dispersing fine precipitated copper particles having a particle diameter of 1 to 100 nm inside a structure in order to improve workability of the steel sheet.

However, in order to precipitate fine Cu particles, Cu needs to be added in a high content of 2 to 5 wt %, and in this case, red brittleness by Cu may occur. In addition, production costs may rise excessively.

As another example, Patent Document 2 discloses a steel sheet that has a microstructure containing 2 to 10% by area of a pearlite phase with ferrite as a matrix structure, and has improved strength through precipitation strengthening and grain refinement by adding elements such as Ti, which are precipitation strengthening elements. In this case, although hole expandability of the steel sheet is preferable, there is a limit in increasing a tensile strength, and a yield strength is high and ductility is low, which may cause cracks during press-forming.

As still another example, Patent Document 3 discloses a method for producing a cold-rolled steel sheet that has both high strength and high ductility by utilizing a tempered martensite phase and has an excellent sheet shape after continuous annealing. However, in the case of this technique, a content of carbon in the steel is 0.2% or more, which is high, and thus, there are problems such as deterioration of weldability and occurrence of a dent defect in a furnace due to a large amount of Si contained.

(Patent Document 1) Japanese Patent Laid-Open Publication No. 2005-264176

(Patent Document 2) Korean Patent Laid-open Publication No. 2015-0073844

(Patent Document 3) Japanese Patent Laid-open Publication No. 2010-090432

DISCLOSURE

Technical Problem

An aspect of the present disclosure is to provide a steel sheet that is suitable for an automobile structural member or the like, and has a high tensile strength of 590 MPa and excellent formability and strain hardening rate (Nu).

An object of the present disclosure is not limited to the above description. The object of the present disclosure will be understood from the general contents of the present specification, and those skilled in the art to which the present disclosure pertains will have no difficulties in understanding the additional objects of the present disclosure.

Technical Solution

According to an aspect of the present disclosure, a steel sheet having excellent formability and strain hardening rate contains: by wt %, 0.10 to 0.16% of carbon (C), 1.0% or less (excluding 0%) of silicon (Si), 1.4 to 2.2% of manganese (Mn), 1.0% or less of chromium (Cr), 0.1% or less (excluding 0%) of phosphorus (P), 0.01% or less (excluding 0%) of sulfur (S), 1.0% or less (excluding 0%) of aluminum (sol.Al), 0.01% or less (excluding 0%) of nitrogen (N), 0.05% or less (excluding 0%) of antimony (Sb), and a balance of Fe and unavoidable impurities; and bainite having an area fraction of 5 to 25%, 3% or more of retained-austenite, and a balance of ferrite and martensite in a microstructure, wherein the steel sheet satisfies the following Relational Expression 1.

$$\{(C+Si+Al)/((10\times(C+Ti+Nb))+(2\times Si)+Mn+Cr)/(TS)\}\times 1{,}000\geq 0.28 \quad \text{[Relational Expression 1]}$$

Where each element represents a weight content, and TS represents a tensile strength (MPa).

According to another aspect of the present disclosure, a method for producing a steel sheet having excellent formability and strain hardening rate includes: preparing a steel slab satisfying the alloy composition; heating the steel slab to a temperature within a range of 1,050 to 1,300° C.; subjecting the heated steel slab to finish hot rolling at an Ar3 transformation point or higher to produce a hot-rolled steel sheet; coiling the hot-rolled steel sheet in a temperature range of 450 to 700° C.; performing cooling to room temperature at a cooling rate of 0.1° C./s or less after the coiling; performing cold rolling at a cold reduction ratio of 40% or more after the cooling to produce a cold-rolled steel sheet; continuously annealing the cold-rolled steel sheet in a temperature range of Ac1+30° C. to Ac3−30° C.; performing stepwise cooling after the continuous annealing; and maintaining the steel sheet for 30 seconds or longer after the stepwise cooling, wherein a cumulative reduction ratio of first and second stands during the cold rolling is 25% or more, the stepwise cooling includes a first cooling performed to 630 to 690° C. at a cooling rate of 10° C./s or less (excluding 0° C./s) and a second cooling performed to 350 to 450° C. at a cooling rate of 5° C./s or more after the first cooling, and the steel sheet satisfies Relational Expression 1.

Advantageous Effects

As set forth above, according to the present disclosure, the steel sheet having high strength and improved formability by optimizing the alloy component system and production conditions of steel may be provided.

As described above, the steel sheet having improved formability of the present disclosure may prevent processing defects such as cracks or wrinkles occurring during the press-forming, and thus has an effect that it may be suitably applied to an automobile structural part having a complex shape requiring high workability and the like.

DESCRIPTION OF DRAWINGS

FIG. 1 illustrates a graph showing changes in a relation between strain hardening indices (N1 and N4), elongations (TE and UE), and tensile strength (TS) (corresponding to Relational Expression 2) according to a relation between specific elements in steel and tensile strength (corresponding to Relational Expression 1) in an exemplary embodiment.

BEST MODE FOR INVENTION

The present inventors of the present disclosure have intensively studied to develop a material having a level of formability that may be suitably used in parts that require processing into a complicated shape among materials for automobiles.

As a result, the present inventors have found that a high-strength steel sheet having a structure advantageous for securing desired physical properties may be provided by optimizing an alloy composition and production conditions, thereby completing the present disclosure.

In particular, the present disclosure is characterized by providing a steel sheet in which fine retained-austenite phases are uniformly distributed around a bainite phase while obtaining a composite structure in which a soft phase and a hard phase are properly dispersed by controlling contents of specific elements in alloy components and optimizing processing conditions for a steel sheet produced through a series of processing.

Such a steel sheet of the present disclosure has a high strain hardening index at an initial stage of plastic deformation, such that strain hardening of the entire material may be uniformly performed, thereby obtaining an effect of increasing a strain hardening index even in a later stage of plastic deformation. As described above, as the strain hardening index is increased in the entire strain rate section, stress and strain are relieved so that they are not concentrated in any one part of the material, and thus, a uniform elongation (UE) and a total elongation (TE) are improved together, which has technical significance.

Hereinafter, the present disclosure will be described in detail.

A steel sheet having excellent formability and strain hardening rate according to an aspect of the present disclosure may contain, by wt %, 0.10 to 0.16% of carbon (C), 1.0% or less (excluding 0%) of silicon (Si), 1.4 to 2.2% of manganese (Mn), 1.0% or less of chromium (Cr), 0.1% or less (excluding 0%) of phosphorus (P), 0.01% or less (excluding 0%) of sulfur (S), 1% or less (excluding 0%) of aluminum (sol.Al), 0.01% or less (excluding 0%) of nitrogen (N), and 0.05% or less (excluding 0%) of antimony (Sb).

Hereinafter, the reason for limiting the alloy composition of the steel sheet provided in the present disclosure as described above will be described in detail.

Meanwhile, in the present disclosure, a content of each element is based on weight, and a ratio of a structure is based on area, unless specifically stated otherwise.

Carbon (C): 0.10 to 0.16%

Carbon (C) is an important element added to strengthen a transformation structure of steel. C achieves high strength of the steel and promotes formation of martensite in composite structure steel. As a content of C is increased, the amount of the martensite in the steel is increased.

However, the content of C exceeds 0.16%, the strength is increased due to the increase in the amount of the martensite in the steel, but a difference in strength with ferrite having a relatively low carbon concentration is increased. Due to such a difference in strength, fracture occurs easily at an interface between phases when stress is applied, which reduces ductility and a strain hardening rate. In addition, weldability is deteriorated, which causes welding defects during processing of client parts. On the other hand, when the content of C is less than 0.10%, it is difficult to secure a desired strength, and it is difficult to secure a small amount of a retained-austenite phase, which is advantageous for obtaining a high uniform elongation.

Therefore, C may be contained in an amount of 0.10 to 0.16%, and more preferably 0.11% or more.

Silicon (Si): 1.0% or Less (Excluding 0%)

Silicon (Si) is a ferrite stabilizing element, and is an element that promotes transformation of ferrite and promotes formation of martensite by promoting a concentration of C into untransformed austenite. In addition, silicon has an excellent solid solution strengthening effect to increase strength of ferrite and is thus effective in reducing a difference in hardness between phases, and is an element useful for securing strength without reducing the ductility of the steel sheet.

When a content of Si exceeds 1.0%, surface scale defects are caused, resulting in deteriorating plating surface quality and impairing chemical conversion coating.

Therefore, in the present disclosure, it is preferable that the content of Si is controlled to 1.0% or less, and 0% is excluded. More preferably, Si may be contained in an amount of 0.2 to 1.0%.

Manganese (Mn): 1.4 to 2.2%

Manganese (Mn) has the effect of refining particles without reducing ductility and precipitating sulfur (S) in the steel as MnS to prevent hot brittleness by formation of FeS. In addition, Mn is an element that strengthens the steel, and also serves to lower a critical cooling rate at which a martensite phase is obtained in composite structure steel. Therefore, Mn is useful for more easily forming martensite.

When a content of Mn is less than 1.4%, the above-described effect may not be obtained, and it is difficult to secure a desired level of strength. On the other hand, when the content of Mn exceeds 2.2%, problems in weldability, hot rolling properties, and the like are likely to occur, the material is unstable due to formation of excessive martensite, and a Mn-Band (a Mn oxide band) is formed in the structure, which causes an increase in risk of occurrence of processing cracks and sheet fracture. In addition, Mn oxide is eluted on a surface during annealing, which greatly inhibits plating properties.

Therefore, in the present disclosure, it is preferable that the content of Mn is controlled to 1.4 to 2.2%. More preferably, Mn may be contained in an amount of 1.5 to 2.1%.

Chromium (Cr): 1.0% or Less

Chromium (Cr) is an element added to improve hardenability of steel and ensure high strength. Cr is effective for forming martensite, and may be advantageous in producing composite structure steel having high ductility by minimizing a decrease in elongation compared to an increase in strength. In particular, Cr forms Cr-based carbides such as $Cr_{23}C_6$ in a hot rolling process. Some of the carbides are dissolved and some of the carbides undissolved remain in the annealing process. Accordingly, the amount of solid solution C in the martensite after cooling may be controlled to an appropriate level or lower. Therefore, Cr has an advantageous effect in producing composite structure steel in which generation of yield point elongation (YP-El) is suppressed and a yield ratio is low.

However, when a content of Cr exceeds 1.0%, the effect thereof is saturated, and hot rolling strength is excessively increased, which causes deterioration of cold rolling properties. In addition, a fraction of the Cr-based carbide is increased and the Cr-based carbide is coarsened, and thus, a size of the martensite after annealing is increased, which causes a reduction in elongation.

Therefore, in the present disclosure, it is preferable that the content of Cr is controlled to 1.0% or less. Even when the content thereof is 0%, there is no difficulty in securing desired physical properties.

Phosphorus (P): 0.1% or Less (Excluding 0%)

Phosphorus (P) is a substitutional element having the greatest solid solution strengthening effect, and is an element that is advantageous for improving in-plane anisotropy and securing strength without significantly deteriorating formability. However, in a case where P is excessively added, the possibility of brittle fracture is greatly increased, such that the possibility of sheet fracture of a slab during hot rolling is increased, and plating surface properties are deteriorated.

Therefore, in the present disclosure, it is preferable that the content of P is controlled to 0.1% or less, and 0% is excluded in consideration of an inevitably added level.

Sulfur (S): 0.01% or Less (Excluding 0%)

Sulfur (S) is an element inevitably added as an impurity element in steel, and it is preferable to manage a content of S as low as possible because it inhibits ductility and weldability. In particular, S has a problem of increasing the possibility of generating red brittleness. Therefore, it is preferable to control the content thereof to 0.01% or less. However, 0% is excluded in consideration of an inevitably added level in a production process.

Aluminum (Sol.Al): 1.0% or Less (Excluding 0%)

Aluminum (sol.Al) is an element added to refine a particle size of steel and deoxidize the steel. In addition, Al, which is a ferrite stabilizing element similar to Si, is an effective component for improving hardenability of martensite by distributing carbon in ferrite into austenite, and is an element useful for improving ductility of a steel sheet by effectively suppressing precipitation of carbides in bainite when held in a bainite region.

When a content of Al exceeds 1.0%, it is advantageous for an increase in strength by a grain refinement effect, but surface defects in a plated steel sheet are likely to occur due to excessive inclusions during a steelmaking continuous casting operation. In addition, production costs rise.

Therefore, in the present disclosure, it is preferable that the content of Al is controlled to 1.0% or less, and 0% is excluded. More preferably, Al may be contained in an amount of 0.7% or less. In the present disclosure, aluminum refers to acid-soluble aluminum (Sol.Al).

Nitrogen (N): 0.01% or Less (Excluding 0%)

Nitrogen (N) is an effective element for stabilizing austenite, and when a content thereof exceeds 0.01%, a refining cost of steel rises sharply, and a risk of occurrence of cracks during a continuous casting is greatly increased by formation of AlN precipitate.

Therefore, in the present disclosure, it is preferable that the content of N is controlled to 0.01% or less, and 0% is excluded in consideration of an inevitably added level.

Antimony (Sb): 0.05% or Less (Excluding 0%)

Antimony (Sb) is distributed in grain boundaries and serves to delay diffusion of oxidizing elements such as Mn, Si, and Al through the grain boundaries. Therefore, Sb suppresses a surface concentration of oxide, and has an effect of suppressing coarsening of the surface concentrate depending on a temperature rise and a hot rolling process change.

When a content of Sb exceeds 0.05%, the effect thereof is saturated, and also, production costs rise and workability is deteriorated.

Therefore, in the present disclosure, it is preferable that the content of Sb is controlled to 0.05% or less, and 0% is excluded. It should be noted that Sb may be more preferably contained in an amount of 0.005% or more.

The remaining component of the present disclosure is iron (Fe). However, unintended impurities may be inevitably mixed from raw materials or surrounding environments in a general production process. Therefore, it is difficult to exclude these impurities. Since these impurities may be recognized in the general production process by those skilled in the art, all the contents thereof are not particularly described in the present specification.

Meanwhile, the steel sheet of the present disclosure does not contain titanium (Ti) and niobium (Nb). In a case where Ti and Nb are contained in the steel, the strength of ferrite significantly is increased. Therefore, when stress is applied from the outside, effective strain of the ferrite is limited, and as a result, the strain hardening rate and the uniform elongation may be significantly reduced.

Therefore, in the present disclosure, Ti and Nb are not contained. However, Ti and Nb may be added in a steel production process at an impurity level, and in this case, the physical properties of the present disclosure are not impaired. Specifically, it should be noted that when a content of each of Ti and Nb is 0.010% or less, it is an impurity level. More preferably, the content of each element may be more preferably 0.008% or less.

In the steel sheet having the alloy composition described above of the present disclosure, it is preferable that a relation between contents of C, Si, Al, Mn, Cr, Nb, and Ti in the steel and a tensile strength (YS) of the steel sheet satisfies the following Relational Expression 1. Here, the inside of the steel refers to a ¼t point of the steel sheet in a thickness direction (where "t" represents a thickness (mm) of the steel sheet).

The main object of the present disclosure is to increase formability and a strain hardening rate as well as high strength. Thereto end, it is necessary to form an advantageous structure for securing intended physical properties by optimizing an alloy composition and production conditions of steel.

Although it will be described in detail below, the present inventors have found that in a case where a soft phase and a hard phase as steel structures are uniformly distributed, the formability and the strain hardening rate may be increased.

Thereto end, it is preferable that the contents of Ti and Nb, which are elements that may impair the uniform elongation of the steel, are lowered as much as possible, the contents of the elements (C, Si, and Al) advantageous in forming a bainite phase and a fine retained-austenite phase are increased, and a ratio of Mn and Cr, which are advantageous for improving hardenability is controlled.

More specifically, a value of the component relational expression represented by the following Relational Expression 1 of 0.28 or more is secured, such that structural organization and physical properties intended in the present disclosure may be advantageously obtained.

When the value of the following Relational Expression 1 is less than 0.28, a target structural organization may not be secured.

$$\{(C+Si+Al)/((10\times(C+Ti+Nb))+(2\times Si)+Mn+Cr)/(TS)\}\times 1{,}000\geq 0.28 \quad \text{[Relational Expression 1]}$$

Where each element represents a weight content, and TS represents a tensile strength (MPa).

The steel sheet having the alloy composition described above of the present disclosure may homogeneously contain a soft phase and a hard phase in a microstructure, and specifically, may be composed of bainite having an area fraction of 5 to 25%, 3% or more of retained-austenite, and a balance of ferrite and martensite.

The steel sheet of the present disclosure contains a certain amount of Si and Al in the steel. Therefore, carbide precipitation is delayed during bainite transformation and carbon (C) is accumulated as untransformed austenite around the bainite, such that a martensite transformation temperature is lowered below room temperature. As a result, it is possible to secure a retained-austenite phase at room temperature.

The bainite phase contributes to securing the strength of the steel and affects the securing of a certain fraction or more of a retained-austenite phase. Therefore, it is preferable that the bainite phase is contained in an amount of 5% by area or more. That is, when the fraction of the bainite phase is 5% by area or more, a concentration of C in the untransformed austenite is promoted, such that it is possible to secure the retained-austenite phase contributing to ductility at a target level of fraction. More preferably, the bainite phase may be contained in an amount of 10% by area or more. However, when the fraction thereof exceeds 25%, the ductility of the steel is reduced, such that it is difficult to promote the improvement of the uniform elongation.

In addition, the steel sheet of the present disclosure contains the retained-austenite phase in an area fraction of 3% or more, and thus, transformation induced plasticity is caused during forming of the steel sheet, which is effective in securing ductility. When the fraction of the retained-austenite phase is excessive, the steel sheet is likely to be vulnerable to liquid metal embrittlement (LME) during spot welding for assembling automobile parts. Therefore, it is preferable to contain the retained-austenite phase in an amount of 10% or less in consideration of this.

In particular, the present disclosure has an effect of increasing the strain hardening rate of the steel material by mainly distributing the retained-austenite phases around the bainite phase.

Specifically, in the present disclosure, it is preferable that the number of distributed fine retained-austenite phases adjacent to the bainite phase, preferably the number of distributed retained-austenite phases having an average grain size of 2 μm or less, is 80% or more of the total number of retained-austenite. That is, a certain fraction of the retained-austenite phases are mainly distributed around the bainite phase, such that it is possible to obtain an effect of uniformly performing strain hardening during plastic deformation.

Here, the phrase of "adjacent to the bainite phase" means a region up to about 10 μm based on the grain boundary of the bainite phase. In this case, it should be noted that the inside of the grain of the bainite phase is not excluded.

Meanwhile, the steel sheet of the present disclosure may further contain a martensite phase in addition to the bainite phase described above as a hard phase, and preferably, the martensite phase may be contained in an area fraction of 10 to 30%.

When the fraction of the martensite phase is less than 10%, a desired level of the strength may not be secured. On the other hand, when the fraction of the martensite phase exceeds 30%, the ductility of the steel is reduced, and thus, the uniform elongation may not be increased.

As described above, in the steel sheet of the present disclosure, the fine retained-austenite phases are uniformly dispersed around the bainite phase, and a composite structure in which the ferrite phase and the martensite phase are formed in appropriate fractions is formed, such that the strain hardening may be performed uniformly in the entire material because a strain hardening index in the early stage (4 to 6%) of plastic deformation is high, thereby obtaining an effect of increasing a strain hardening index even in the late stage (10% to uniform elongation %) of plastic deformation.

In particular, in the steel sheet of the present disclosure, a relation between a strain hardening index (N1) measured in a strain section of 4 to 6%, a strain hardening index (N4) measured in a strain section of 10% to uniform elongation (%), a total elongation (TE), a uniform elongation (UE), and a tensile strength (TS) may satisfy the following Relational Expression 2.

In addition, the steel sheet of the present disclosure may have a high tensile strength of 590 MPa or more.

$$(TS \times TE \times UE \times N1 \times N4) \geq 14{,}000 \quad \text{[Relational Expression 2]}$$

Where a unit is MPa %.

The high-strength steel sheet of the present disclosure may include a zinc-based plating layer formed on at least one surface thereof.

In this case, the zinc-based plating layer is not particularly limited, and may be a zinc plating layer mainly containing zinc or a zinc alloy plating layer containing aluminum and/or magnesium in addition to zinc.

Hereinafter, according to another aspect of the present disclosure, a method for producing a steel sheet having excellent formability and strain hardening rate provided in the present disclosure will be described in detail.

Briefly, according to the present disclosure, a desired steel sheet may be produced through [steel slab reheating—hot rolling—coiling—cold rolling—continuous annealing—cooling], and then, a process of [hot-dip zinc plating—(final) cooling] may be further performed.

The conditions for each step will be described in detail below.

[Steel Slab Heating]

First, the steel slab satisfying the alloy composition described above may be prepared and then heated.

This process is performed to smoothly perform a subsequent hot rolling process and to obtain sufficient physical properties of a desired steel sheet. In the present disclosure, the process conditions of such a heating process are not particularly limited as long as they are common conditions. As an example, the heating process may be performed in a temperature range of 1,050 to 1,300° C.

[Hot Rolling]

The steel slab heated as described above may be subjected to finish hot rolling at an Ar3 transformation point or higher to produce a hot-rolled steel sheet, and in this case, it is preferable that an outlet temperature satisfies Ar3 to Ar3+50° C.

When the outlet temperature during the finish hot rolling is lower than Ar3, ferrite and austenite dual-phase region rolling is performed, which may cause material unevenness. On the other hand, when the temperature is higher than Ar3+50° C., the material unevenness may be caused by formation of an abnormal coarse grain due to high-temperature rolling, which causes coil distortion during subsequent cooling.

More specifically, the finish hot rolling may be performed in a temperature range of 800 to 1,000° C.

[Coiling]

It is preferable that the hot-rolled steel sheet produced as described above is coiled.

The coiling is preferably performed in a temperature range of 450 to 700° C. When the coiling temperature is lower than 450° C., the strength of the hot-rolled steel sheet is excessively increased due to formation of an excessive martensite or bainite phase, which may cause shape defects and the like due to a load during subsequent cold rolling. On the other hand, when the coiling temperature is higher than 700° C., a surface concentration and internal oxidation of elements such as Si and Mn in the steel, which causes deterioration of wettability of hot-dip zinc plating, may become severe.

[Cooling]

It is preferable that the coiled hot-rolled steel sheet is cooled to room temperature at an average cooling rate of 0.1° C./s or less (excluding 0° C./s). More preferably, the cooling may be performed at an average cooling rate of 0.05° C./s or less, and more preferably 0.015° C./s or less. Here, the cooling refers to an average cooling rate.

As described above, the coiled hot-rolled steel sheet is cooled at a predetermined rate, such that a hot-rolled steel sheet in which carbides serving as nucleation sites for austenite are finely dispersed may be obtained. That is, the fine carbides may be uniformly dispersed in the steel during the hot rolling process, and the austenite phases may be finely dispersed and formed in the steel while the carbides are dissolved during subsequent annealing. Therefore, after completing the annealing, uniformly dispersed fine martensite phases may be obtained.

[Cold Rolling]

A cold-rolled steel sheet may be produced by cold rolling the coiled hot-rolled steel sheet according to the above, and in this case, the cold rolling may be performed at a cold reduction ratio (cumulative reduction ratio) of 40% or more.

In particular, in the present disclosure, a cumulative reduction ratio of an initial stand, preferably, first and second stands during the cold rolling are controlled to 25% or more so as to increase energy stored inside the steel, such that it is possible to obtain an effect of acting the energy as a driving force to promote recrystallization of ferrite in a subsequent annealing process. Due thereto, it is possible to impart an effect of lowering a fraction of non-recrystallized ferrite in the steel.

In a case where non-recrystallized ferrite is present in the steel, the ductility of the steel is deteriorated due to local strain and stress concentration, whereas the recrystallized ferrite contributes to improvement of the ductility by alleviating strain and stress concentration.

When the cumulative reduction ratio of the initial first and second stands during the cold rolling is less than 25% or a cold reduction ratio of the first to final stands is less than 40%, it is difficult to secure a target thickness, and it is difficult to correct the shape of the steel sheet. When the cold reduction ratio of the first to final stands during the cold rolling exceeds 90%, cracks are likely to occur at an edge portion of the steel sheet, and a cold rolling load is caused.

It should be noted that, in the present disclosure, the cold rolling may be performed using a rolling mill including 5 or 6 stands, but is not limited thereto.

[Continuous Annealing]

It is preferable that the cold-rolled steel sheet produced as described above be subjected to continuous annealing. The continuous annealing treatment may be performed, for example, in a continuous alloying hot-dip plating furnace.

The continuous annealing process is a process for forming ferrite and austenite phases together with recrystallization and for decomposing carbon.

It is preferable that the continuous annealing treatment is performed in a temperature range of Ac1+30° C. to Ac3−30° C., and more preferably in a temperature range of 770 to 830° C.

When the temperature is lower than Ac3−30° C. during the continuous annealing, sufficient recrystallization is not achieved, and it is difficult to sufficiently form austenite. Therefore, it is difficult to secure a desired fraction of each of the martensite phase and the bainite phase after annealing.

On the other hand, when the temperature is higher than Ac1+30° C., productivity is reduced, and the austenite phase is excessively formed. Therefore, the fraction of each of the martensite phase and the bainite phase is significantly increased after cooling, such that yield strength is increased and ductility is reduced. As a result, it is difficult to secure a low yield ratio and high ductility. In addition, a surface concentration is increased due to elements such as Si and Mn, which inhibit wettability of hot-dip zinc plating, and thus, the plating surface quality may be deteriorated.

[Stepwise Cooling]

It is preferable that the cold-rolled steel sheet subjected to the continuous annealing as described above is subjected to stepwise cooling.

Specifically, it is preferable to perform the cooling to 630 to 690° C. at an average cooling rate of 10° C./s or less (excluding 0° C./s) (this cooling is referred to as a first cooling) and then to perform the cooling to 350 to 450° C. at an average cooling rate of 5° C./s or more (this cooling is referred to as a second cooling).

First Cooling

When the end temperature of the first cooling is lower than 630° C., the diffusion activity of carbon is low due to a temperature that is too low, resulting in an increase in concentration of carbon in ferrite. Therefore, the yield ratio is increased, which causes an increase in occurrence of cracks during processing. On the other hand, when the end temperature is exceeds 690° C., it is advantageous in terms of carbon diffusion, but is disadvantageous in that an excessively high cooling rate is required for subsequent cooling (second cooling). In addition, when the average cooling rate during the first cooling exceeds 10° C./s, the carbon diffusion is not sufficiently performed.

Meanwhile, a lower limit of the average cooling rate is not particularly limited, but may be 1° C./s or more in consideration of productivity.

Second Cooling

It is preferable that the first cooling is completed and then the second cooling is performed under the conditions described above. In this case, a target microstructure may be induced to be formed by controlling the cooling end temperature and the cooling rate.

When the end temperature of the second cooling is lower than 350° C. or exceeds 450° C., a bainite phase may not be sufficiently formed, such that fine retained-austenite phases distributed around the bainite phase may not be sufficiently secured. Due thereto, a uniform dispersion effect of the respective phases in the steel may not be obtained, such that it is difficult to improve workability.

In addition, when the average cooling rate during the second cooling is less than 5° C./s, a pearlite phase is formed, such that a bainite phase may not be formed at a target level. Meanwhile, an upper limit of the average cooling rate is not particularly limited, and may be appropriately selected by those skilled in the art in consideration of specifications of a cooling facility. For example, the second cooling may be performed at 100° C./s or less.

In addition, in the second cooling, a hydrogen cooling facility using hydrogen gas ($H_2$ gas) may be used. As described above, the cooling is performed using the hydrogen cooling facility, such that the surface oxidation which may occur during the second cooling may be suppressed.

Meanwhile, when the stepwise cooling is performed as described above, the cooling rate during the second cooling may be faster than the cooling rate during the first cooling.

[Maintaining]

After completing the stepwise cooling as described above, it is preferable that the steel sheet is maintained in the cooled temperature range for 30 seconds or longer.

The maintaining process is performed after the second cooling described above, such that the bainite phase may be formed and carbon may be concentrated in an untransformed austenite phase adjacent to the formed bainite phase. This is intended to form a fine retained-austenite phase in a region adjacent to bainite after completing all subsequent processes.

In this case, when the maintaining time is shorter than 30 seconds, the amount of carbon concentrated in the untransformed austenite phase is insufficient, and thus, a desired microstructure may not be secured. On the other hand, when the maintaining time is longer than 200 seconds during the maintaining process, the fraction of the bainite is excessive, and a certain fraction of the martensite phase in the final structure may not be secured.

[Hot Dip Galvanizing]

It is preferable that a hot-dip zinc-based plated steel sheet is produced by dipping the steel sheet subjected to the stepwise cooling and maintaining processes as described above in a hot-dip zinc-based plating bath.

In this case, the hot-dip zinc plating may be performed under common conditions, and as an example, the hot-dip zinc plating may be performed in a temperature range of 430 to 490° C. In addition, the composition of the hot-dip zinc-based plating bath in the hot-dip zinc plating is not particularly limited, and the hot-dip zinc-based plating bath may be a pure zinc plating bath or a zinc-based alloy plating bath containing Si, Al, Mg, and the like.

[Final Cooling]

After completing the hot-dip zinc plating, it is preferable that cooling is performed to Ms (martensite transformation initiation temperature)—100° C. or lower at a cooling rate of 5° C./s or more. In this process, a fine retained-austenite phase may be sufficiently formed in a region adjacent to the bainite phase of the steel sheet (here, the steel sheet corresponds to a base material at a bottom of a plating layer).

When the end temperature of the cooling is higher than Ms—100° C., a fine martensite phase and an appropriate fraction of a retained-austenite phase may not be sufficiently secured, and when an average cooling rate is less than 5° C./s, a fraction of the martensite is decreased due to a cooling rate that is too slow. Therefore, a desired level of the strength may not be secured. An upper limit of the cooling rate during the final cooling is not particularly limited. It should be noted that the final cooling may be performed at 100° C./s or less in consideration of cooling facility specifications.

There is no problem in securing a desired structure even when the cooling is performed to room temperature. Here, the room temperature may be about 10 to 35° C.

An alloyed hot-dip zinc-based plated steel sheet may be obtained by subjecting the hot-dip zinc-based plated steel sheet to alloying heat treatment before the final cooling, if necessary. In the present disclosure, the process conditions of the alloying heat treatment are not particularly limited as long as they are common conditions. As an example, the alloying heat treatment process may be performed in a temperature range of 480 to 600° C.

Furthermore, a final cooled hot-dip zinc-based plated steel sheet or alloyed hot-dip zinc-based plated steel sheet is subjected to temper rolling, if necessary, such that a large amount of dislocation is formed in the ferrite in the steel to further improve bake hardenability.

At this time, a reduction ratio is preferably less than 1% (excluding 0%). When the reduction ratio is 1% or more, it is advantageous in terms of dislocation formation, but side effects such as occurrence of sheet fracture may be caused due to limitations in facility capability.

The steel sheet produced as described above of the present disclosure may contain bainite having an area fraction of 5 to 25%, 3% or more of retained-austenite, and a balance of ferrite and martensite in a microstructure. In this case, the number of retained-austenite having an average grain size of 2 μm or less around the bainite phase may be 80% or more of the total number of retained-austenite.

In such a steel sheet of the present disclosure, a relation between the specific alloying elements in the steel and the tensile strength satisfies not only Relational Expression 1, but also the mechanical properties satisfy Relational Expression 2, such that the formability and the strain hardening rate may be improved.

Hereinafter, the present disclosure will be described in more detail with reference to Examples. However, the following Examples are provided to illustrate and describe the present disclosure in detail, but are not intended to limit the scope of the present disclosure. This is because the scope of the present disclosure is determined by contents disclosed in the claims and contents reasonably inferred therefrom.

MODE FOR INVENTION

Examples

Steel slabs having the alloy compositions shown in Table 1 were prepared, the steel slabs were heated in a temperature range of 1,050 to 1,250° C., and then the heated steel slabs were subjected to final hot rolling in a temperature range of Ar3+50° C. to 950° C. Thereafter, each of the hot-rolled steel sheets was coiled at 450 to 700° C. and then subjected to cooling to room temperature at a cooling rate of 0.1° C./s or less, thereby producing a hot-rolled steel sheet.

Thereafter, each of the hot-rolled steel sheets was subjected to cold rolling under the rolling conditions shown in Table 2 to produce a cold-rolled steel sheet, the cold-rolled steel sheet was subjected to continuous annealing under the conditions shown in Table 2, and then stepwise cooling (first and second cooling) was performed. After the second cooling was completed, the steel sheet was maintained at the temperature for 30 to 200 seconds.

Thereafter, the steel sheet was subjected to zinc plating in a hot-dip zinc plating bath at 430 to 490° C., and the zinc-plated steel sheet was subjected to final cooling to room temperature and then was subjected to temper rolling to less than 1%, thereby producing a hot-dip zinc-based plated steel sheet.

The microstructure of each of the steel sheets produced as described above was observed, and mechanical properties were evaluated. The results are shown in Table 3.

At this time, the tensile test for each of the test pieces was performed in the L direction using DIN standards, and the value of the strain hardening rate in a section of a strain rate of 4 to 6% and a section of a strain rate of 10 to UE % was measured as the strain hardening rate (n).

In addition, the fraction of the microstructure was analyzed using the matrix structure at a ¼*t* point of the thickness of the steel sheet subjected to continuous annealing. Specifically, after Nital corrosion, the fraction of each of ferrite (F), bainite (B), martensite (M), and retained-austenite (R-A) was measured using FE-SEM, an image analyzer, EBSD, and an X-ray diffractor (XRD), and the occupancy ratio of the retained-austenite having a fine size (an average grain size of 2 μm or less) present within 10 μm of the bainite grain boundary was calculated. The number of fine retained-austenite for calculating the occupancy ratio of the fine retained-austenite (R-A occupancy ratio, %) was counted by the point count method.

TABLE 1

| | Alloy composition (wt %) | | | | | | | | | | | |
|---|---|---|---|---|---|---|---|---|---|---|---|---|
| Classification | C | Si | Mn | P | S | Sol. Al | Cr | B | Ti | Nb | N | Sb |
| Inventive Steel 1 | 0.12 | 0.5 | 1.9 | 0.01 | 0.003 | 0.2 | 0.2 | 0 | 0 | 0 | 0.007 | 0.03 |
| Inventive Steel 2 | 0.12 | 0.7 | 1.9 | 0.009 | 0.002 | 0.025 | 0 | 0 | 0 | 0 | 0.006 | 0.03 |
| Inventive Steel 3 | 0.12 | 0.7 | 1.6 | 0.01 | 0.003 | 0.025 | 0.2 | 0 | 0 | 0 | 0.007 | 0.03 |
| Inventive Steel 4 | 0.14 | 0.7 | 1.7 | 0.01 | 0.003 | 0.025 | 0 | 0 | 0 | 0 | 0.005 | 0.03 |
| Inventive Steel 5 | 0.12 | 0.5 | 1.9 | 0.008 | 0.002 | 0.4 | 0.5 | 0 | 0 | 0 | 0.006 | 0.03 |
| Inventive Steel 6 | 0.12 | 0.5 | 1.9 | 0.009 | 0.003 | 0.2 | 0 | 0 | 0 | 0 | 0.006 | 0.03 |
| Comparative Steel 1 | 0.12 | 0.7 | 1.9 | 0.01 | 0.003 | 0.025 | 0.2 | 0 | 0 | 0.02 | 0.007 | 0.03 |
| Comparative Steel 2 | 0.12 | 0.7 | 1.9 | 0.01 | 0.002 | 0.025 | 0.2 | 0 | 0 | 0 | 0.007 | 0.03 |
| Comparative Steel 3 | 0.12 | 0.7 | 1.9 | 0.009 | 0.002 | 0.025 | 0 | 0.0015 | 0.015 | 0 | 0.005 | 0.03 |
| Comparative Steel 4 | 0.14 | 0.7 | 1.9 | 0.01 | 0.003 | 0.025 | 0 | 0 | 0 | 0 | 0.006 | 0 |
| Comparative Steel 5 | 0.12 | 0.5 | 1.9 | 0.01 | 0.003 | 0.025 | 0 | 0 | 0 | 0 | 0.007 | 0.02 |
| Comparative Steel 6 | 0.12 | 0.7 | 1.6 | 0.009 | 0.002 | 0.025 | 0.2 | 0 | 0.015 | 0.02 | 0.006 | 0 |
| Comparative Steel 7 | 0.12 | 0.7 | 1.9 | 0.008 | 0.003 | 0.2 | 0.5 | 0 | 0 | 0 | 0.005 | 0 |

TABLE 2

| Classification | Cold rolling: Total cold reduction ratio (%) | Cold rolling: Cumulative reduction ratio of first and second stands (%) | Continuous annealing: Annealing temperature (° C.) | Continuous annealing: First cooling end temperature (° C.) | Continuous annealing: First cooling rate (° C./s) | Continuous annealing: Second cooling end temperature (° C.) | Continuous annealing: Second cooling rate (° C ./s) | Continuous annealing: Final cooling rate (° C./s) |
|---|---|---|---|---|---|---|---|---|
| Inventive Steel 1 | 65 | ≥25 | 820 | 630 | 5 | 390 | 25 | 5 |
| Inventive Steel 2 | 60 | ≥25 | 800 | 680 | 5 | 400 | 12 | 10 |
| Inventive Steel 3 | 70 | ≥25 | 830 | 680 | 4 | 420 | 20 | 5 |
| Inventive Steel 4 | 65 | ≥25 | 780 | 650 | 5 | 400 | 25 | 5 |
| Inventive Steel 5 | 65 | ≥25 | 800 | 680 | 4 | 380 | 30 | 5 |
| Inventive Steel 6 | 70 | ≥25 | 820 | 670 | 5 | 420 | 20 | 7 |
| Comparative Steel 1 | 65 | ≥25 | 830 | 630 | 5 | 540 | 30 | 8 |
| Comparative Steel 2 | 60 | ≥25 | 850 | 695 | 5 | 420 | 27 | 8 |
| Comparative Steel 3 | 70 | <25 | 820 | 680 | 4 | 350 | 28 | 8 |
| Comparative Steel 4 | 32 | ≥25 | 830 | 650 | 5 | 400 | 25 | 5 |
| Comparative Steel 5 | 65 | <25 | 760 | 680 | 5 | 560 | 18 | 7 |
| Comparative Steel 6 | 28 | ≥25 | 800 | 680 | 4 | 400 | 15 | 10 |
| Comparative Steel 7 | 45 | ≥25 | 780 | 670 | 5 | 400 | 15 | 10 |

TABLE 3

| Classification | Microstructure (% by area): B | M | R-A | R-A occupancy ratio | Mechanical properties: YS (MPa) | TS (MPa) | TE (%) | UE (%) | N1 (4 to 6%) | N4 (10 to UE %) | Relational Expression 1 | Relational Expression 2 |
|---|---|---|---|---|---|---|---|---|---|---|---|---|
| Inventive Steel 1 | 18 | 12 | 5 | 93 | 344 | 661 | 26.4 | 18.9 | 0.270 | 0.202 | 0.29 | 17988 |
| Inventive Steel 2 | 13 | 14 | 3 | 86 | 370 | 639 | 28.4 | 18.3 | 0.248 | 0.186 | 0.29 | 15319 |
| Inventive Steel 3 | 21 | 11 | 6 | 98 | 333 | 636 | 29.0 | 19.2 | 0.266 | 0.196 | 0.30 | 18463 |
| Inventive Steel 4 | 16 | 13 | 4 | 91 | 385 | 635 | 29.2 | 18.4 | 0.261 | 0.185 | 0.30 | 16474 |
| Inventive Steel 5 | 22 | 10 | 6 | 95 | 315 | 699 | 26.0 | 18.1 | 0.280 | 0.198 | 0.32 | 18237 |
| Inventive Steel 6 | 17 | 12 | 4 | 92 | 363 | 607 | 29.2 | 18.5 | 0.270 | 0.190 | 0.33 | 16821 |
| Comparative Steel 1 | 3 | 35 | 0 | 0 | 431 | 734 | 21.0 | 17.4 | 0.240 | 0.163 | 0.23 | 10492 |
| Comparative Steel 2 | 8 | 30 | 1 | 65 | 344 | 719 | 22.0 | 17.8 | 0.250 | 0.171 | 0.25 | 12037 |
| Comparative Steel 3 | 7 | 32 | 0 | 0 | 380 | 697 | 23.1 | 16.6 | 0.247 | 0.175 | 0.26 | 11553 |
| Comparative Steel 4 | 7 | 22 | 0 | 0 | 371 | 688 | 23.4 | 17.4 | 0.246 | 0.171 | 0.27 | 11784 |
| Comparative Steel 5 | 5 | 9 | 0 | 0 | 371 | 598 | 27.2 | 16.2 | 0.224 | 0.179 | 0.26 | 10565 |
| Comparative Steel 6 | 9 | 15 | 2 | 69 | 418 | 659 | 26.1 | 16.2 | 0.259 | 0.177 | 0.27 | 12774 |
| Comparative Steel 7 | 8 | 35 | 1 | 60 | 316 | 738 | 21.3 | 17.0 | 0.251 | 0.174 | 0.28 | 11671 |

In Table 3, Inventive Steels 1 to 6 contain ferrite as the remaining structure except for B, M, and R-A in the microstructure. Meanwhile, in Comparative Steels 1 to 7, the remaining structure is composed of only ferrite, or contains some pearlite in ferrite.

In addition, the R-A occupancy ratio in Table 3 is expressed by calculating the ratio (R-A*/R-At) of the number of fine retained-austenite (R-A*) having an average grain size of 2 μm or less present in 10 μm based on the bainite grain boundary to the total number of retained-austenite (R-At) as a percentage.

In addition, in Table 3, YS represents a yield strength, TS represents a tensile strength, UE represents a uniform elongation, TE represents a total elongation, each of N1 and N4 represents a strain hardening index at the corresponding strain rate, and the unit of Relational Expression 2 is MPa %.

As shown in Tables 1 to 3, in the cases of Inventive Steels 1 to 6 in which the alloy composition system and the production conditions of the steel satisfy all the suggestions of the present disclosure, the intended microstructure is formed, such that the tensile strength is 590 MPa or more, which is high strength, and the relation between the tensile strength, the elongations (UE and TE), and the strain hardening indices (N1 and N4) (corresponding to Relational Expression 2) of 14,000 or more is secured. Therefore, the desired formability and strain hardening rate may be secured.

On the other hand, in the cases of Comparative Steels 1 to 7 in which one or more conditions of the alloy composition system and the production conditions of the steel do not satisfy the suggestions of the present disclosure, it can be confirmed that the intended microstructure is not formed, such that the value of Relational Expression 2 of less than 14,000 is secured, and thus, the formability and the strain hardening rate are not secured.

FIG. 1 illustrates a graph showing changes in a relation between strain hardening indices (N1 and N4), elongations (TE and UE), and tensile strength (TS) (corresponding to Relational Expression 2) according to a relation between specific alloying elements (C, Si, Al, Mn, Cr, Nb, and Ti) and tensile strength (corresponding to Relational Expression 1) of each of Inventive Steels and Comparative Steels.

As illustrated in FIG. 1, it can be appreciated that when the relation between C, Si, Al, Mn, Cr, Nb, and Ti and the tensile strength satisfies 0.28 or more, the value of Relational Expression 2 of 14,000 or more may be secured.

The invention claimed is:

1. A steel sheet comprising: by wt %, 0.10 to 0.16% of carbon (C), 1.0% or less (excluding 0%) of silicon (Si), 1.4 to 2.2% of manganese (Mn), 1.0% or less of chromium (Cr), 0.1% or less (excluding 0%) of phosphorus (P), 0.01% or less (excluding 0%) of sulfur(S), 1.0% or less (excluding 0%) of aluminum (sol.Al), 0.01% or less (excluding 0%) of nitrogen (N), 0.05% or less (excluding 0%) of antimony (Sb), and a balance of Fe and unavoidable impurities; and bainite having an area fraction of 5 to 25%, 3% or more of retained-austenite, and a balance of ferrite and martensite in a microstructure, wherein the steel sheet satisfies the following Relational Expression 1:

$$\{(C+Si+Al)/((10\times(C+Ti+Nb))+(2\times Si)+Mn+Cr)/(TS)\}\times 1{,}000\geq 0.28 \text{[Relational Expression 1]}$$

where each element represents a weight content, and TS represents a tensile strength (MPa).

2. The steel sheet of claim 1, wherein the number of retained-austenite having an average grain size of 2 μm or less adjacent to the bainite phase is 80% or more of the total number of retained-austenite.

3. The steel sheet of claim 1, wherein the martensite phase is contained in an area fraction of 10 to 30%.

4. The steel sheet of claim 1, wherein the steel sheet includes a zinc-based plating layer formed on at least one surface thereof.

5. The steel sheet of claim 1, wherein the steel sheet has a tensile strength of 590 MPa or more, and a relation between a strain hardening index (N1) measured in a strain section of 4 to 6%, a strain hardening index (N4) measured in a strain section of 10 to uniform elongation (%), a tensile strength (TS), a total elongation (TE), and a uniform elongation (UE) satisfies the following Relational Expression 2:

$$(TS\times TE\times UE\times N1\times N4)\geq 14{,}000 \text{[Relational Expression 2]}$$

where a unit is MPa %.

* * * * *